United States Patent [19]

Mason et al.

[11] Patent Number: 5,045,118

[45] Date of Patent: Sep. 3, 1991

[54] METHOD OF REMOVING DEBRIS AND DUST FROM A CARPET

[75] Inventors: Richard A. Mason, Buffalo; Archie A. Weidner, Minnetonka, both of Minn.

[73] Assignee: Tennant Company, Minneapolis, Minn.

[21] Appl. No.: 518,818

[22] Filed: May 4, 1990

[51] Int. Cl.[5] ..... B08B 5/04; A47L 5/14; A47L 9/04; A47L 9/06

[52] U.S. Cl. ..... 134/21; 15/345; 15/349; 15/363

[58] Field of Search ..... 134/21; 15/349, 345, 15/363

[56] References Cited

U.S. PATENT DOCUMENTS 2,701,377 2/1955 Luksch ..... 15/349
2,960,714 11/1960 Senne ..... 15/349
3,881,215 7/1975 Krier et al. ..... 15/340
3,979,789 9/1976 Peabody et al. ..... 15/349

OTHER PUBLICATIONS

Battery-Power Vac, Appliance Manufacturer, July, 1989.
Tennant Bulletin 1480/480, Scrubbers, Copyright 1989.
Parts Book Sheet for PreSweep of Tennant, 1480/480.

*Primary Examiner*—Theodore Morris
*Assistant Examiner*—Saeed Tahir Chaudhry
*Attorney, Agent, or Firm*—Kinzer, Plyer, Dorn, McEachran & Jambor

[57] ABSTRACT

This is concerned with an improved sweeping head and sweeping machine for sweeping carpet in one pass with an articulated sweeping head having an improved sweeping action and a substantial power savings.

4 Claims, 2 Drawing Sheets

METHOD OF REMOVING DEBRIS AND DUST FROM A CARPET

SUMMARY OF THE INVENTION

A primary object of the invention is a carpet sweeper designed and constructed for battery powered operation.

Another object is a carpet sweeper constructed and arranged for unmanned or robotic operation.

Another object is an articulated sweeping head for a carpet sweeper which moves up or down to follow the undulations of a carpeted floor independently of the rest of the carpet sweeper.

Another object is a sweeping head for a carpet sweeper which is counterbalanced so the sweeping head rests lightly, on a carpet.

Another object is a unit of the above type which separates the larger particles by flicking them forward into a hopper and the smaller particles or dust which are vacuumed up behind.

Another object is a dirt and debris separation action of the above type which relies upon location of the hopper and the vacuum outlet relative to a rotary sweeping brush.

Another object is a unit of the above type which increases the percentage of total horsepower or wattage to the brush drive and decreases the percentage of total horsepower or wattage to the vacuum drive as compared with a conventional vacuum cleaner having an agitator brush.

Another object is a sweeper of the above type that requires on the order of half of the total power of an equivalent vacuum cleaner with an agitator brush.

Another object is a sweeping head for a unit of the above type that controls the air inlet around the bottom of the sweeping head so that a high velocity air flow is acquired behind the brush.

Another object is a sweeping head which is suitable for use with a mobile unmanned or robotic propelling unit.

Another object is a sweeping head which facilitates robotic carpet cleaning by cleaning a carpet in a single pass.

Another object is a sweeping method or separation procedure of the above type which overcomes the cohesion between dirt and dust and the carpet strands.

Another object is a low friction skid arrangement for a sweeping head of the above type that supports a substantial part of the weight on the carpet with a low unit pressure and also serves as an air seal.

Another object is a skid mounted sweeping head for a carpet sweeper.

Another object is a controlled air seal for a sweeping head of the above type.

Another object is an articulated sweeping head of the above type which has a debris hopper.

Another object is a brush sweeper of the above type with a hopper and a vacuum cleaner.

Another object is an articulated sweeping head which consists of an electrically driven brush rotating bottom side forward in the direction of movement of the unit, a hopper in front of the brush, a brush housing and a vacuum system connected to the brush housing behind the brush.

Another object is a sweeping head which has a combination skid and vacuum seal on the bottom in engagement with the carpet.

Another object is a sweeping unit of the above type specifically constructed and arranged for battery operation to provide maximum run time on the battery.

Another object is a sweeping unit of the above type which cleans a carpet as well in a single pass as a conventional vacuum cleaner does in several passes.

Another object is a sweeping head which can be moved as easily sideways or backward as it can be moved forward.

Another object is a sweeping head for a sweeper of the above type which is constructed to prevent the sweeping head from digging into the carpet.

Another object is a combination brush sweeper and vacuum cleaner which performs or cleans a carpet better than either a brush sweeper or a vacuum cleaner.

Other objects will appear from time to time in the ensuing specification and drawings.

DESCRIPTION OF THE PREFERRED EMBODIMENT

Figure 1:
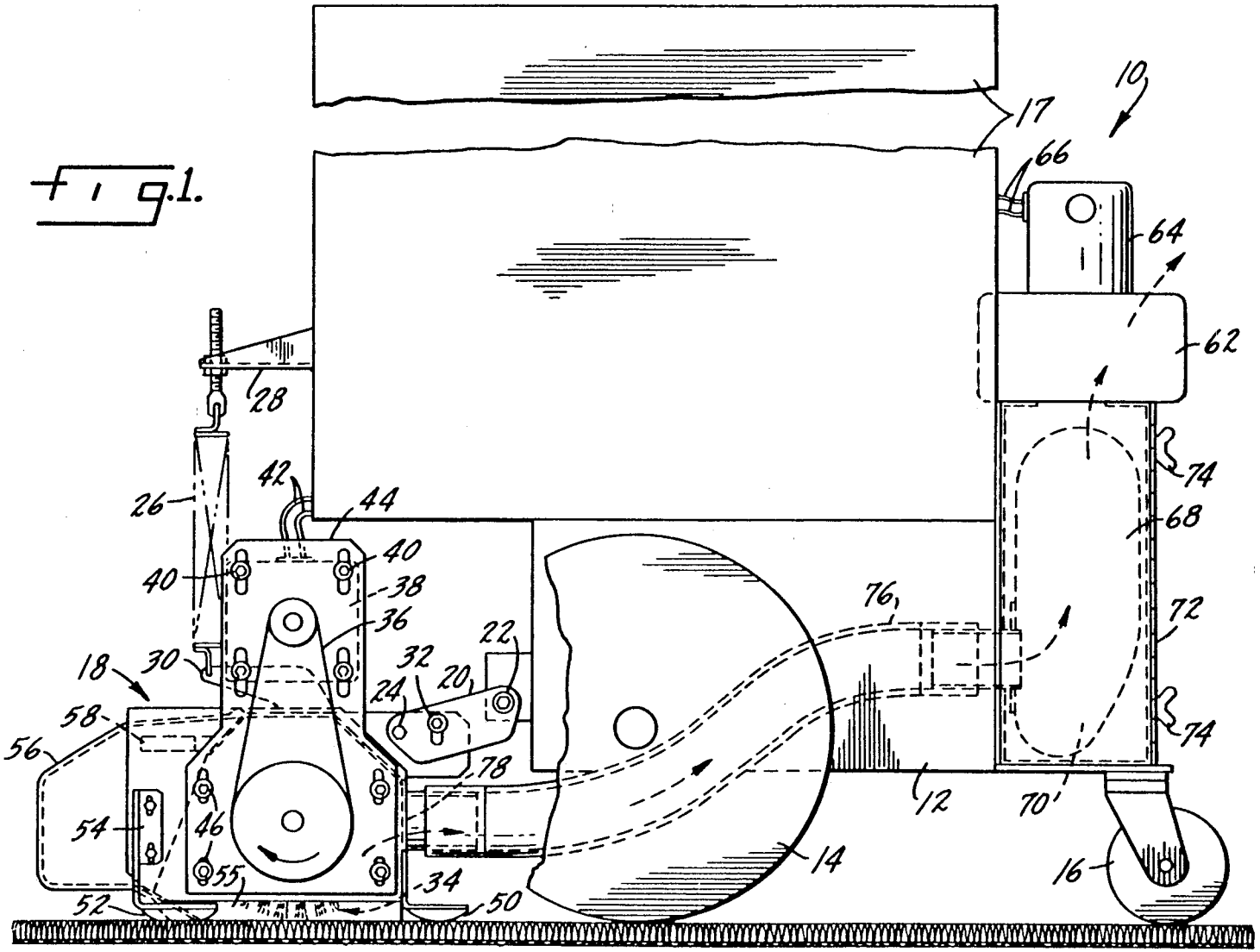
FIG. 1 is a side view of a sweeper embodying the invention.

In FIG. 1 a mobile propelling unit is indicated generally at 10 which may include a frame 12 mounted on drive wheels 14, one on each side, with a single rear caster wheel 16 which is centrally mounted. Two caster wheels, one on each near corner, may also be used. The unit is specifically intended to be a battery powered machine and a housing 17 is shown on the frame which includes suitable batteries for operating the drive wheels, vacuum system and sweeping head. Housing 17 will also contain suitable motors and drive components to drive the wheels 14. Propelling unit 10 is preferably unmanned, in the nature of a mobile robot, in which case housing 17 will include guidance and control equipment for a mobile robot. Alternatively, propelling unit 10 may be guided and controlled by a human operator with controls not shown. The construction of propelling unit 10 is not, however, the subject of this patent except as it relates to sweeping head 18, so its other aspects will not be discussed.

A sweeping head, indicated generally at 18, is connected to the front of the propelling unit frame 12 by a pivoted connection which includes links 20, one on each side, pivoted to the frame at 22 and attached to the sweeping head at 24 and 32. The weight of the sweeping head is counterbalanced by a spring 26 or the like which is adjustably connected by a bracket 28 to the frame of the propelling unit at its upper end and to an arm 30 on the top of the sweeping housing. The links 20 are provided with an adjustment 32 so that when the sweeping head is properly positioned, the adjustment 32 may be tightened to fix the position of the sweeping head on the links.

Figure 2:
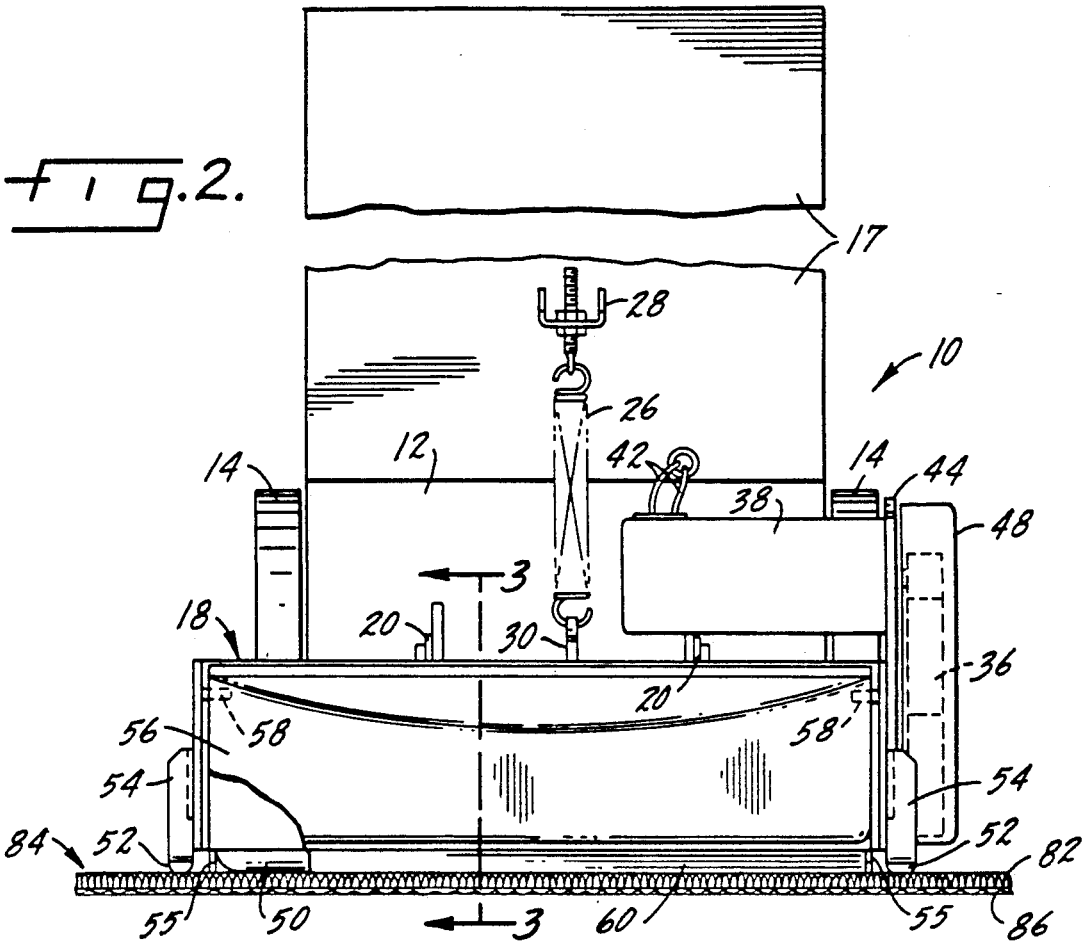
FIG. 2 is a front view of FIG. 1.

A cylindrical brush 34 is rotatably mounted in the sweeping head so that it is disposed laterally to the direction of movement of the machine. The brush is belt driven as at 36 by a motor 38 mounted on top of the sweeper housing with an adjustable mounting 40 so that the belt may be properly tensioned. Wires 42 supply current to the brush motor. A side plate 44 supports the brush motor and is adjustably mounted to the side of the brush housing by connections 46 in FIG. 1 with a suitable belt guard 48 removably mounted over the belt and pulleys as shown in FIG. 2. Adjustment 46 is provided for brush wear.

Figure 3:
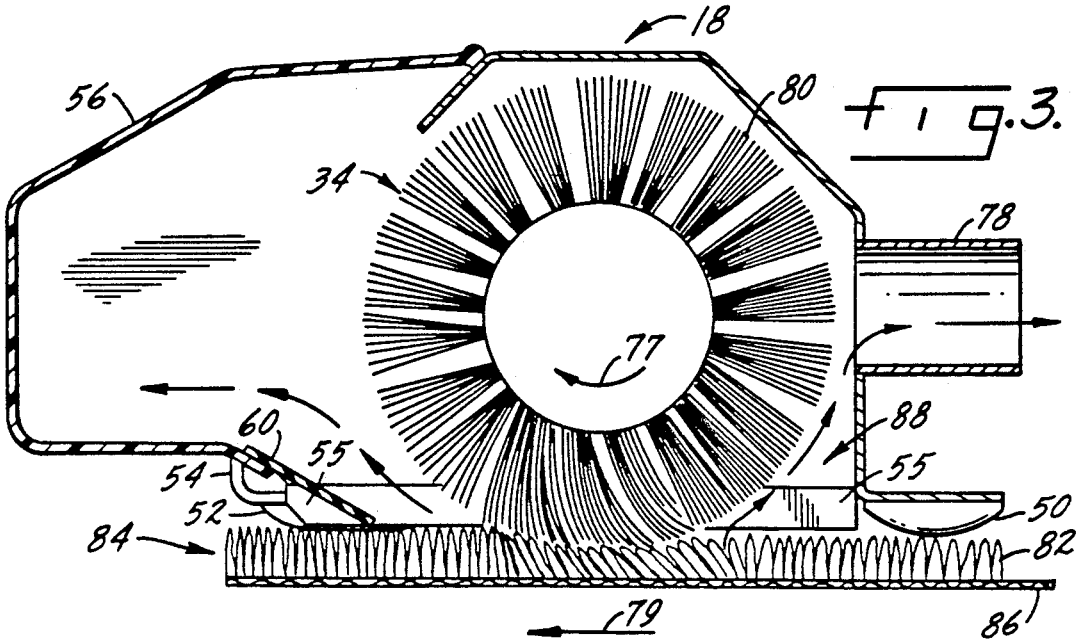
FIG. 3 is a longitudinal section view of the sweeping head on line 3—3 of FIG. 2 and on an enlarged scale, with parts removed for clarity.

A skid 50 depends from the rear of the brush housing and extends the full width thereof to engage a carpet being swept. This skid is curved up like a sled runner at the front and back as shown in FIGS. 1 and 3 and also at both ends as shown in FIG. 2. The brush housing may also have a skid 52 mounted one on each side at the front thereof each by a suitable bracket 54 or the like. These brackets may have elongated mounting holes so that the height of the skids may be adjusted for various carpet conditions. Front skids 52 should be curved up at front and rear and both sides like rear skid 50. Side skids 52 may be omitted on certain types of carpets. The rear skid 50 is preferably made of a low friction plastic such as polyethylene although it may be an equivalent plastic. This has the advantage that the skid serves as an air seal and contributes to supporting the sweeping head with a low friction engagement with the carpet which reduces the power draw to propel the machine. The skids 52 on each side may be made of the same material or its equivalent. Side skirts 55 made of rubber or the like, and disposed longitudinally along each side of the brush housing control and regulate air flow.

A debris hopper 56 is removably mounted on the front of the machine with slots which fit on lugs 58 shown in FIGS. 1 and 2 on each side. A flexible skirt or sweeping lip 60 shown in FIGS. 2 and 3 along the lower edge of the hopper, for example of rubber, is disposed so that debris propelled forward by the brush will easily enter the hopper.

A vacuum fan 62 or blower of a conventional type suitable for use in a vacuum cleaner may be mounted on the rear of the housing with a drive motor 64 supplied with current by wires 66. A housing 68 below it contains a suitable dust bag 70 which may be made of porous paper or fabric. Such dust bags are well known in vacuum cleaners. The dust bag may be of the type that is cleaned and returned to service or it may be a one time use throwaway unit if desired. The bag may be removed and cleaned through a rear access closed by a hinged panel 72 held in place by thumb screws 74 or the like. A flexible tube 76 communicates the vacuum to the rear of the sweeping head through an opening 78 to an area within the sweeping head directly behind the brush for reasons explained hereinafter.

The action or operation or behavior of the sweeping head is shown in FIG. 3 where it will be noted that the brush is rotated as shown by arrow 77 in a direction bottom side forward in the direction of travel shown by arrow 79 so that the bristles 80 thereof engage the pile or strands 82 of the carpet 84 which has a conventional backing 86. The result is that the bristles 80 are deflected rearwardly, relative to the direction of movement of the machine while the strands 82 of the carpet are deflected forwardly as shown in FIG. 3. As the sweeper bristles 80 move out of contact with the carpet strands 82, they flick the larger particles of debris forwardly into the debris hopper 56. At the same time the forwardly bent strands 82 of the carpet will be released and they will flex rearwardly which will break the cohesion between the smaller dust particles and the strands so that a lot of the smaller particles will become airborne in the area 88 behind the brush and directly adjacent the intake or connection 78 for the vacuum. Thus most of the larger particles will be propelled forwardly into the debris hopper and most of the smaller particles or dust will become airborne directly next to the vacuum source.

The use, operation and function of the invention are as follows.

The invention is a carpet sweeper with low power draw and superior performance suitable for use with an unmanned propelling unit and a method of using it. The machine has an articulated sweeping head with relatively somewhat more power being supplied to the brush motor and relatively much less power to the vacuum motor as compared to a conventional vacuum cleaner with an agitator brush. This is because the brush throws the bulk of the heavy debris into the front hopper, relieving the vacuum from the job of pulling heavy debris into the dust bag. In any vacuum cleaner the lifting of heavy debris from a floor requires much more vacuum power than lifting light debris and dust. Therefore sweeping up the heavy debris with a brush allows a substantial reduction in vacuum. Vacuum sweeping requires much more power than brush sweeping, so reducing the vacuum demand reduces the overall power requirement. For example, 10 amps to drive a vacuum cleaner blower and agitator brush from a 110 volt can be provided for the vacuum fan motor and, in a typical condition, 5 amps for the brush motor making a total of 19. And since the unit is battery operated at 24 volts, only 456 watts are used, which is a substantial power savings. The result is that an adequate run time can be obtained from a battery pack of small enough size and weight to make a robotic carpet cleaning machine practical. The run time, in a specific situation, may be on the order of a minimum of five hours, thereby making it commercially acceptable.

The action, behavior or method of operation of the sweeping head as illustrated in FIG. 3 is considered important. The sweeping head has a pivoted attachment to the frame of the mobile propelling unit and is counterbalanced with an adjustable counterbalance spring so that the degree of down pressure of the brush housing on the carpet strands may be accurately set for different types of carpet. The amount or degree of interference or overlap between the brush bristles and the carpet strands is significant in accomplishing what may be thought of as a two phase pickup, first, heavy and/or large debris being propelled forwardly into the hopper ahead of the brush and, second, light debris such as dust becoming airborne behind the brush to be picked up by the vacuum. Insufficient overlap or interference between the brush and carpet bristles would, first, not cause sufficient heavy debris to be propelled forwardly and, second, would result in insufficient snapback or reverse flex of the carpet strands so that insufficient dust or light debris would become airborne. It is thought that the penetration of the brush bristles into the carpet pile may also have a beneficial effect in breaking the adhesion of dust particles to the carpet fibers. The optimum setting may be a matter of judgment resulting possibly from trial and error and experience with possibly the dominant factor being the appearance of the carpet afterwards. It has been observed that the quality of cleaning done by this unit in one pass requires several passes when done by a conventional vacuum cleaner.

The invention is primarily concerned with an unmanned or robotic battery powered unit, where it will be difficult, if not impossible, to move the sweeping head back and forth as is traditionally done with a conventional carpet sweeper. So the operation of the sweeping head must be structured for a one pass operation with the resulting carpet looking clean. This capability could be useful on a manned sweeper as well as on an unmanned one.

It will be understood that once the links 20 between the frame and sweeping head are set and fixed at 32, the sweeping head is still free to pivot about point 22. Since the spring 26 does not counterbalance all of the weight of the sweeping head, and since the sweeping head is being pushed somewhat downwardly by the links 20, it could have the ability to "dive" into some types of carpet, pivoting counterclockwise about 22 in FIG. 1. The forward low friction skids 52 prevent this. However, there are other types of carpet where this "diving" tendency will not occur, and the side skids will not be needed.

The bristles of the brush may be thought of as soft so that little power is required to make them flex rearwardly, as shown in FIG. 3, when in engagement with the carpet. As they move free of the carpet they snap forward and propel the heavier debris forward into the debris hopper. The brush design should be the least aggressive that will, at the same time, do the job thereby reducing its power draw to a minimum. The brush bristles' stiffness should also be coordinated to the stiffness or "give" of carpet strands. The object is to have the carpet strands or bristles flex and break the cohesion of the dust and light debris in the carpet sufficiently to get the dust and light debris airborne so that the vacuum can capture them.

In addition, the otherwise open bottom of the brush housing is sealed sufficiently by the low friction side and rear skids and side skirts so that a controlled air inlet is provided. This is mainly at the rear corners of the sweeping head between the rear skid and the side skirts. This controlled air intake results in high velocity air flow behind the brush into the vacuum intake to effectively remove the airborne dust and light debris. Some air also enters the sweeping head ahead of the brush under the hopper lip 60. The brush pushes or fans this air up and over the top to the rear of the sweeping chamber where it is pulled into the vacuum system. Any light or small debris thrown forward by the brush will be picked up in this air stream and taken out to the dust bag. This might be thought of as material on the surface of the carpet and not necessarily heavy debris.

The rear skid 50 and the forward skids 52 are made of a low friction, material and shaped so that they do not create substantial resistance to movement of the head in any direction, thereby reducing the power draw to propel the machine. At the same time the rear skid effectively seals the rear of the brush housing and the side skirts 55 seal the sides so that less vacuum is required, meaning lower amperage draw by the vacuum motor because of the improved sealing for the bottom of the brush housing. Whereas side skids and a separate sealing skirt have been shown on each side, it should be understood that the side skids might be combined with the rear skid into one long U-shaped low friction skid. This would serve the support functions of the rear skid and side skids and the sealing functions of the rear skid and side skirts. The side skirts could thus be eliminated. The debris hopper in front is small and may be easily removed and dumped by hand.

The result is a combination sweeper and vacuum cleaner which performs better than either a sweeper alone or a vacuum cleaner alone. It is very efficient in a one pass operation, which is primarily important for robotic operation where the unit cannot be pushed back and forth as is convention with a vacuum cleaner. Another advantage is that by propelling the heavy debris into the front hopper, the filter bag in the vacuum system will have extended life and will require servicing less frequently.

The direction of rotation of the brush, bottom side forward, creates some resistance to forward movement of the machine, but it is not much because a relatively soft brush is used and it can be easily taken care of by additional but not excessive input to the drive wheels.

Whereas the preferred form and several variations of the invention have been shown, described and suggested, it should be understood that suitable additional modifications, changes, substitutions, and alterations may be made without departing from the invention's fundamental theme We therefore wish that the invention be unrestricted except as by the appended claims.

The embodiments of the invention in which an exclusive property or privilege is claimed are defined as follows:

1. A method of removing debris and dust from a carpet which has a base and a pile made of strands upstanding therefrom, including the steps of applying a rotary cylindrical brush to the carpet, moving the brush in a forward direction along the carpet while rotating it, causing sufficient contact between the bristles of the brush and the carpet to bend the carpet strands a predetermined amount, rotating the brush in a direction bottom side forward in the forward direction and at a speed sufficient to propel larger debris forwardly from the brush and, at the same time, to bend the carpet strands forwardly and the brush bristles rearwardly, providing a debris hopper in close proximity in front of the brush to catch and store the large debris propelled forwardly by the brush bristles, allowing the carpet strands to freely flex upwardly after the brush bristles move out of contact therewith to cause small dust particles to be propelled into the air from the carpet strands, communicating a vacuum source to a point directly adjacent and above the carpet behind the brush so that the propelled dust particles will be removed before they fall by gravity back into the carpet, and further including the step of regulating the inward air flow behind the brush in response to the vacuum source so that the air moving between the rear of the brush and the point of the vacuum source communication will be at a relatively high velocity.

2. The method of claim 1 further characterized by and including the step of supporting the brush, hopper and point of vacuum source communication, as a unit, in light contact with the carpet.

3. A method of removing debris and dust from a carpet with a carpet sweeper, constructed to be moved in a forward direction and having a frame with a sweeping head attached thereto and a rotary cylindrical brush disposed laterally in the sweeping head with a power drive for rotating the brush, including the steps of rotating the brush in interfering contact with the carpet in a direction bottom side forward in the forward direction of movement, setting the amount of interference contact between the brush and the carpet to propel larger and/or heavier debris from the carpet forwardly and to cause the carpet strands to freely flex upwardly after the brush moves out of contact therewith, providing a debris hopper in front of the brush constructed and arranged to receive and store the large and/or heavy debris propelled by the brush, communicating a vacuum source to the sweeping head behind the brush with a power means for operating it to remove smaller debris and dust propelled upwardly by the carpet after the brush moves out of contact with it, supplying adequate power to the power drive for the brush so that at least most of the large and/or heavy debris will be propelled by the brush into the debris hopper, at the same time, supplying only enough power to the power means for the vacuum source to pick up the smaller debris and dust from the carpet, and further including the step of restricting the air inlet to the sweeper head so that the dust therein will be picked up by a relatively high velocity air current.

4. The method of claim 3 further characterized by and including the step of supporting the brush, hopper and point of vacuum source communication, as a unit, in light contact with the carpet.

* * * * *